US008402732B1

(12) United States Patent
Wen

(10) Patent No.: US 8,402,732 B1
(45) Date of Patent: Mar. 26, 2013

(54) TWISTED CABLE

(76) Inventor: Yuan-Hung Wen, Hemei Town (TW)

( * ) Notice: Subject to any disclaimer, the term of this patent is extended or adjusted under 35 U.S.C. 154(b) by 0 days.

(21) Appl. No.: 13/402,800

(22) Filed: Feb. 22, 2012

(51) Int. Cl.
*D07B 1/06* (2006.01)

(52) U.S. Cl. ..... 57/213

(58) Field of Classification Search ..... 57/213, 57/215, 230
See application file for complete search history.

(56) References Cited

U.S. PATENT DOCUMENTS 3,130,536 A * 4/1964 Peterson et al. ..... 57/9
3,822,542 A * 7/1974 Naud et al. ..... 57/215
3,972,175 A * 8/1976 Hiller ..... 57/213
4,349,694 A * 9/1982 Vives ..... 174/128.1
4,470,249 A * 9/1984 Chiappetta et al. ..... 57/213
4,809,492 A * 3/1989 Fischer ..... 57/212
4,980,517 A * 12/1990 Cardas ..... 174/129 R
5,105,612 A * 4/1992 Brown ..... 57/213
5,171,942 A * 12/1992 Powers ..... 174/129 R
5,400,580 A * 3/1995 Kuriya et al. ..... 57/212
5,418,333 A * 5/1995 Sanders ..... 174/129 R
5,711,143 A * 1/1998 Munakata et al. ..... 57/215
5,946,898 A * 9/1999 Kurata et al. ..... 57/215

* cited by examiner

*Primary Examiner* — Shaun R Hurley

(57) ABSTRACT

The twisted cable is produced by entwisting plural surround wires together on a central wire. The surround wires have several different sizes. The surround wires are arranged in a particular arrangement so as to reduce elongation when stretch force is exerted on the twisted cable. In addition, the outer surround wires have smoothened outer surfaces, so that the twisted cable has smooth and satiny outer surface. Friction and abrasion caused by pulling the twisted cable is reduced.

7 Claims, 3 Drawing Sheets

TWISTED CABLE

BACKGROUND OF THE INVENTION

1. Field of the Invention

The present invention relates to a metal cable.

2. Description of the Prior Art

Metal cable is frequently used in brake assembly of bicycle or motorbike. Metal cable is used for activating brake clamp when user grabs and presses handle of the brake assembly. Conventionally, metal cable is manufactured by twisting several metal wires. To obtain batter operation performance, metal cable which has lowered friction, minimized elongation, and greater flexibility is desired.

To reduce friction caused in operation, metal cable, as disclosed in U.S. Pat. No. 986,817, is entwisted with several flat wires at outer surface thereof. However, differentiated outer layer which has specified appearance would peel off easily.

Additionally, some metal cables, as disclosed in U.S. Pat. No. 3,778,993 and U.S. Pat. No. 4,311,001, are prepared with smoothened outer surface by pressing and deforming outer wires thereof. However, such serious deformation causes not only troubles in manufacturing, but damage in mechanical properties such as elongation coefficient. Moreover, the metal cables provided are still covered be lines and veins. Friction and abrasion would still occur in operation.

Another metal cable, as described in U.S. Pat. No. 4,809,492, is provided with several elliptical wires. The elliptical wires are twisted on the central cable. Thus, outer surface is smoothened and veins on the outer surface are lessened. However, interval vacant space takes a considerable space in the cable. Effective cross section area of the wire is descended. As a result, mechanical properties of the metal cable are also damaged.

The present invention is, therefore, arisen to obviate or at least mitigate the above mentioned disadvantages.

SUMMARY OF THE INVENTION

The main object of the present invention is to provide a metal cable which is prepared for batter operation performance in brake assembly.

To achieve the above and other objects, a twisted cable of the present invention includes a central wire and several surround wires.

The surround wires arranges around the central wire. The surround wires are arranged in layers which are concentrically defined outwardly from the central wire as an inner layer, a middle layer, and an outer layer.

The surround wires are classified according to sizes of cross sections thereof, and classified into first wires, second wires, third wires, and fourth wires, which are ranged from the smallest to the largest.

The inner layer comprises at least six second wires. Size of cross section of each second wire is not larger than size of cross section of the central wire.

The middle layer comprises plural first wires and plural third wires. The third wires are interspersed between any two adjacent first wires of the first wires. Quantity of the first wires of the middle layer, quantity of the third wires of the middle layer, and quantity of the second wires of the inner layer are the same.

The outer layer comprises plural fourth wires. Quantity of the fourth wires of the outer layer is equal to total quantity of the first wires and the third wires of the middle layer.

Each of the fourth wires has an inner surface facing the central wire and an outer surface away from the central wire. Curvature of the outer surface is smaller than curvature of the inner surface from a cross sectional viewpoint. The surround wires are twisted on the central wire together.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
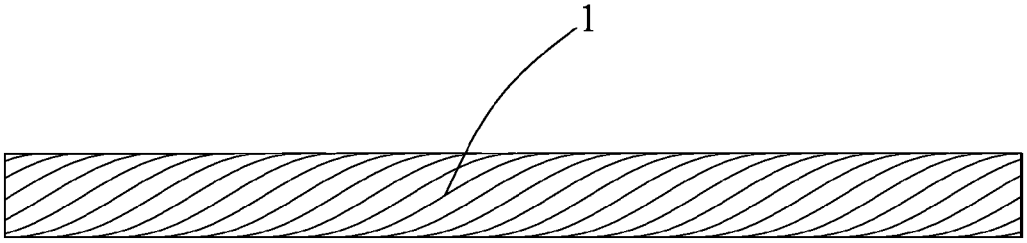
FIG. 1 is a side view showing a first embodiment of the present invention.
Figure 2:
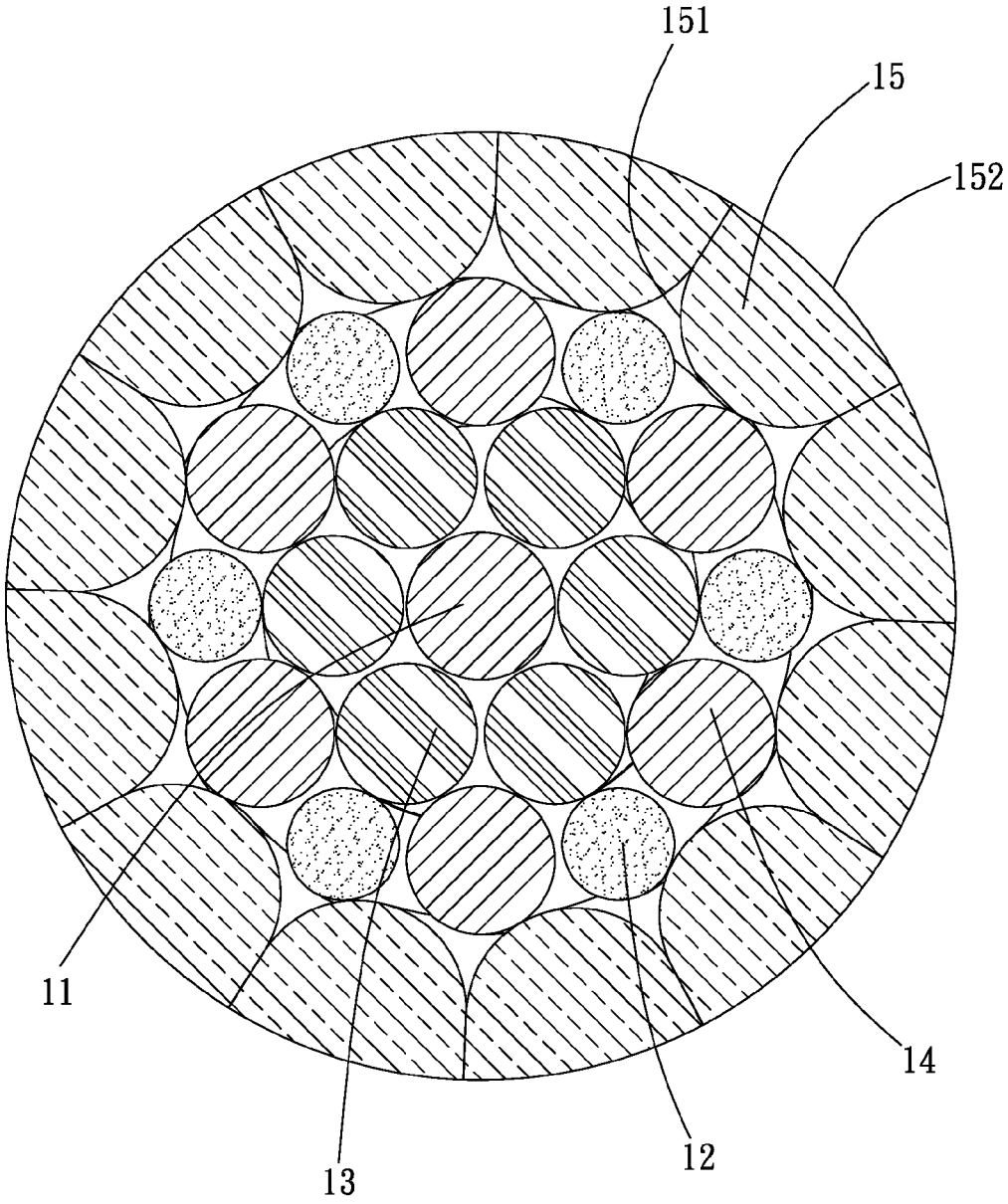
FIG. 2 is a profile showing a first embodiment of the present invention.
Figure 3:
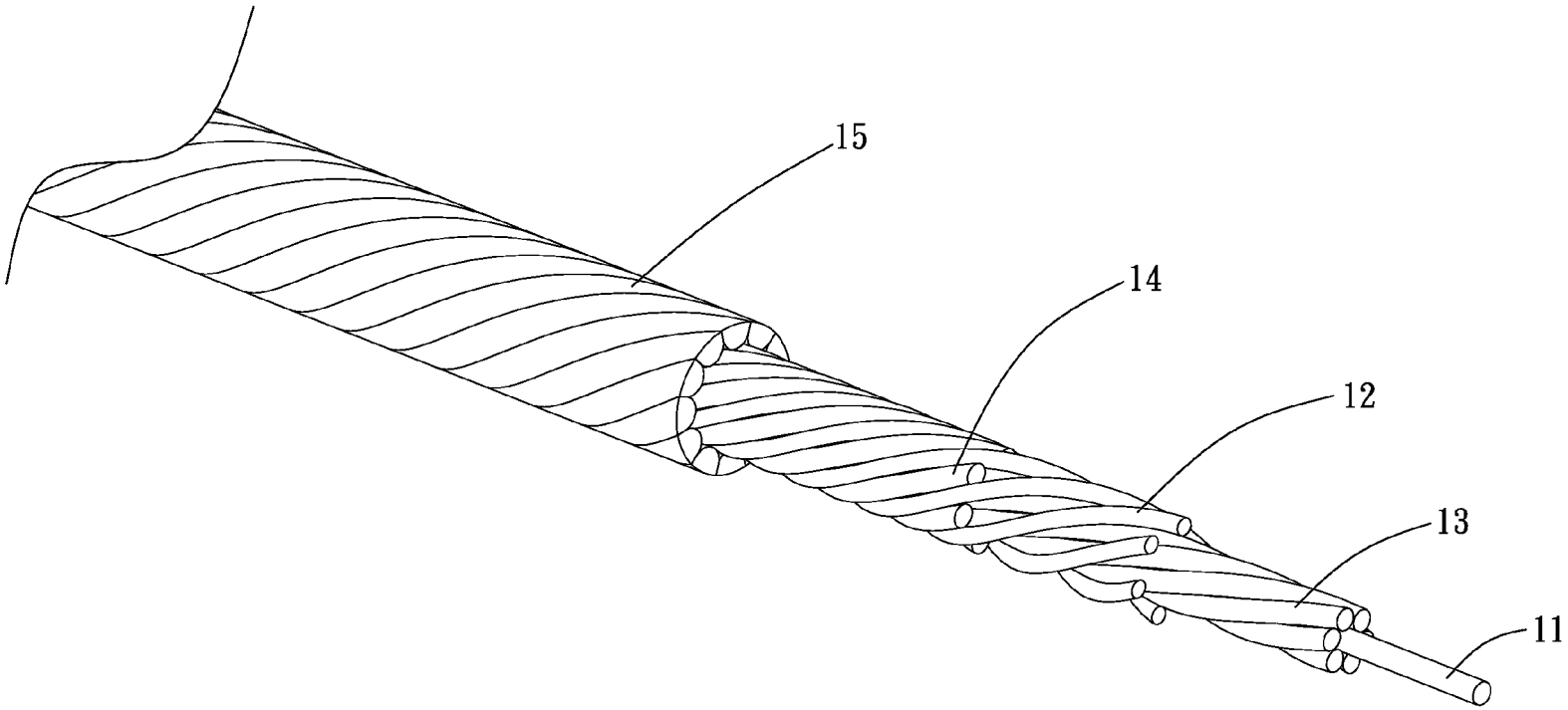
FIG. 3 is a schematic drawing showing a first embodiment of the present invention.

Please refer to FIG. 1 to FIG. 3 for a first embodiment of the present invention. The twisted cable 1 of the present embodiment includes several wires. The wires are bundled and entwisted. As shown in FIG. 2 and FIG. 3, interval vacant space may still remain between the wires. Preferably, the wires are forced together inwardly in entwisting. Thus, the wires would be deformed slightly, and interval vacant space remained in the twisted cable is minimized, as described in U.S. Pat. No. 4,311,001. In the present embodiment, all of the wires of the twisted cable are single metal wire. Alternatively, the wires of the twisted cable can be prepared from twisting several wires.

The wires of the twisted cable 1 include a central wire 11 and several surround wires. The surround wires are arranged around the central wire 11. The surround wires are arranged in layers which are concentrically defined outwardly from the central wire 11 as an inner layer, a middle layer, and an outer layer. In other words, the inner layer is located between the central wire and the middle layer, the middle layer is located between the inner layer and the outer layer, and these three layers are defined circularly and annularly in transversal cross section. The surround wires are classified according to sizes of cross section thereof, in particular, are classified into first wires 12, second wires 13, third wires 14, and fourth wires 15 by ranging the surround wires from the smallest to the largest. In other words, the first wires 12 have the smallest cross section in the surround wires. Cross sections of the first wires 12, the second wires 13, and the third wires 14 are preferably formed circularly before entwisting or pressing.

The inner layer includes several second wires 13 which are annularly arranged. Cross section of the second wire 13 is not larger than cross section of the central wire 11. Therefore, there are six or more than six second wires 13 in the inner layer. When cross section of the second wires 13 are smaller than cross section of the central wire 11, gaps would be defined and remained between the second wires 13. Preferably, ratio of radius of contour of cross section of each second wire 13 to radius of contour of cross section of the central wire 11 is not smaller than 0.8. Thus, the inner layer includes just six second wires 13.

The middle layer includes several first wires 12 and several third wires 14. The first wires 12 and the third wires 14 are annularly arranged. The third wires 14 are interspersed between any two adjacent first wires 12. Therefore, the third wires 14 and the first wires 12 are alternatively arranged. Quantities of the first wires 12 and the third wires 13 are equal to quantity of the second wires 12 of the inner layer respectively. In the present embodiment, first, second, and third wires are all six wires, and are eighteen wires in total. Preferably, sizes of cross section of the third wires 14 are equal to size of cross section of the central wire 11 respectively. Each third wire 14 is adjacent to two second wires 13, and each first wire 12 is adjacent to one second wires 13. Thus, the third wires 14, which are larger than the first wires 12, are held in the recesses between any two adjacent second wires 13.

The outer layer includes several fourth wires 15 which are annularly arranged. Quantity of the fourth wires 15 is equal to total quantity of the first wires 12 and the third wires 14. In the present embodiment, the middle layer includes six first wires 12 and six third wires 14. Thus, there are twelve fourth wires 15 in the outer layer. Preferably, each fourth wire 15 is located adjacent to one first wire 12 and one third wire 14. Thus, the fourth wires 15 are held in or adjoined to the recess between one of the first wires 12 and the adjacent third wire 14. Each fourth wire 15 has an inner surface 151 and an outer surface 152. From a cross sectional viewpoint, curvature of the outer surface 152 is smaller than curvature of the inner surface 151. That is to say, in comparison with the inner surface 151, the outer surface 152 is smoothened. From the cross sectional viewpoint, contour of the outer surface 152 may be an arc, as shown in FIG. 2, or be straight line in alternative. In addition, as shown in FIG. 2, the outer surfaces 152 of the fourth wires 15 are circularly connected as a circle. The cross sectional viewpoint here is a transverse observation on the whole twisted cable. However, transverse observation on each fourth wire 15 would show a similar contour mentioned above.

To take structure strength, weight, and thickness in consideration, the wires may be manufactured in the sizes below:

First wires 12: 0.17 mm in diameter;

Second wires 13: 0.21 mm in diameter;

Third wires 14 and central wire 11: 0.24 mm in diameter;

Fourth wires 15: 0.32 mm in maximum width.

However, the sizes mentioned above are not made unchangeable. Sizes of the wires can be magnified or shrunk by a predetermined scale.

Accordingly, the twisted cable 1 has smoothened outer surface. Friction and abrasion caused in pulling are minimized. When the twisted cable 1 is assembled in brake assembly, resistance caused in pulling the twisted cable is minimized, too. Thus, handle of brake assembly can pull the twisted cable dexterously and precisely.

In addition, the wires of inner layer and middle layer are arranged around the central wire 11. Interval vacant space is reduced. Thus, elongation of the twisted cable is also reduced.

Moreover, internal space is remained between the middle layer and the outer layer. Thus, the twisted cable can be bent or curved easily. Fitting for bicycle or motorbike is facilitated.

What is claimed is:

1. A twisted cable, comprising:

a central wire and plural surround wires, the surround wires arranging around the central wire, the surround wires being arranged in layers which are concentrically defined outwardly from the central wire as an inner layer, a middle layer, and an outer layer;

wherein the surround wires are classified according to sizes of areas of transversal cross sections thereof, and classified into first wires, second wires, third wires, and fourth wires, which are ranged from the smallest to the largest;

wherein each transversal cross section of each surround wire is perpendicular to an axial direction of the surround wire;

wherein the inner layer comprises at least six second wires, size of area of transversal cross section of each second wire is not larger than size of area of transversal cross section of the central wire;

wherein the middle layer comprises plural first wires and plural third wires, the third wires are interspersed between any two adjacent first wires of the first wires, quantity of the first wires of the middle layer, quantity of the third wires of the middle layer, and quantity of the second wires of the inner layer are the same;

wherein the outer layer comprises plural fourth wires, quantity of the fourth wires of the outer layer is equal to total quantity of the first wires and the third wires of the middle layer;

wherein each of the fourth wires has an inner surface facing the central wire and an outer surface away from the central wire, curvature of the outer surface is smaller than curvature of the inner surface from a cross sectional viewpoint;

wherein the surround wires are twisted on the central wire together.

2. The twisted cable of claim 1, wherein size of area of transversal cross section of each third wire is equal to size of area of transversal cross section of the central wire.

3. The twisted cable of claim 1, wherein size of area of transversal cross section of each second wire is smaller than size of area of transversal cross section of the central wire.

4. The twisted cable of claim 1, wherein each third wire is adjacent to two of the second wires, and each first wire is adjacent to one of the second wires.

5. The twisted cable of claim 1, wherein the outer surfaces of the fourth wires are circularly connected as a circle from a cross sectional viewpoint.

6. The twisted cable of claim 1, wherein each fourth wire is adjacent to one of the first wires and one of the third wires.

7. The twisted cable of claim 1, wherein the central wire, the first wires, the second wires, and the third wires has circular cross sections respectively before the surround wires are twisted, ratio of radius of contour of cross section of each second wire to radius of contour of cross section of the central wire is not smaller than 0.8.

* * * * *